US008499716B2

(12) United States Patent
Norcross

(10) Patent No.: US 8,499,716 B2
(45) Date of Patent: Aug. 6, 2013

(54) PORTABLE SPRAY CONTAINMENT ENCLOSURE

(76) Inventor: Richard James Norcross, Darnestown, MD (US)

( * ) Notice: Subject to any disclaimer, the term of this patent is extended or adjusted under 35 U.S.C. 154(b) by 990 days.

(21) Appl. No.: 12/458,325

(22) Filed: Jul. 8, 2009

(65) Prior Publication Data

US 2010/0009616 A1 Jan. 14, 2010

Related U.S. Application Data

(60) Provisional application No. 61/134,121, filed on Jul. 8, 2008.

(51) Int. Cl.
*B05B 1/28* (2006.01)

(52) U.S. Cl.
USPC ..... 118/326

(58) Field of Classification Search
USPC ..... 454/185–186, 188–193, 49–67; 118/305, 118/312, 323, 326
See application file for complete search history.

(56) References Cited

U.S. PATENT DOCUMENTS

| | | | | |
|---|---|---|---|---|
| 4,286,417 | A * | 9/1981 | Shelton | 451/2 |
| 4,558,657 | A * | 12/1985 | Rohrbach | 118/70 |
| 4,825,598 | A * | 5/1989 | Schlick | 451/87 |
| 5,688,323 | A * | 11/1997 | Kane et al. | 118/326 |
| 5,775,979 | A * | 7/1998 | Coke et al. | 451/87 |
| 5,833,521 | A * | 11/1998 | McPhee et al. | 451/87 |
| 6,554,025 | B1 * | 4/2003 | Fitter | 137/571 |
| 7,455,580 | B2 * | 11/2008 | Cheng | 454/50 |

* cited by examiner

*Primary Examiner* — Steven B McAllister
*Assistant Examiner* — Jamil Decker
(74) *Attorney, Agent, or Firm* — Davidson Berquist Jackson & Gowdey LLP

(57) ABSTRACT

A portable overspray painting containment enclosure with an air curtain seal formed between the enclosure and a surface being painted that entrains overspray inside an air flow that is directed into the interior of the enclosure and through a filter system to prevent overspray from escaping into the atmosphere.

21 Claims, 9 Drawing Sheets

PORTABLE SPRAY CONTAINMENT ENCLOSURE

FIELD OF THE DISCLOSURE

This disclosure relates to a device and method for capturing over spray fumes and particles of paint when painting large surfaces using a containment enclosure that provides an effective seal between the periphery of the enclosure and the surface being painted, wherein the containment enclosure is itself mounted to a movable aerial work platform.

BACKGROUND OF THE INVENTION

The present invention concerns a spray enclosure and, more particularly, to an aerial work platform that includes a portable spray enclosure.

The surfaces of large structures such as ships, buildings, bridges, and storage tanks slowly deteriorate when exposed to the environment. Lead, zinc, tin, copper and other heavy metal based paints protect such surfaces, but must be periodically refreshed or replaced to maintain their effectiveness. During maintenance, minute particles of the coating, called overspray, are inadvertently released. If not contained, the overspray carries the heavy metals into the environment, endangering people, plants, and animals and contaminating nearby structures.

Overspray contamination is a significant and persistent problem. Shipyards often enclose the entire ship, including the workers and their equipment, within a canvas and plastic shroud to control overspray. Enshrouding a ship is expensive in material, labor, and time. Furthermore, such a total ship enclosure interferes with other necessary ship maintenance activities. Firms have developed automated machines with local overspray capture shrouds that capture the overspray. But these machines are prohibitively expensive and do not permit the operator to paint the smooth surface desired by the ship's owner. Man-sized, portable enclosures for coating application or coating cleaning have been unable to adequately capture the overspray.

In order to effectively capture the overspray, an enclosure must have a mechanism to maintain a seal in the gap between the enclosure and the surface being painted. An example of one is a man-size portable enclosure, in the form of a tube-like structure with a large opening directed towards the surface to be painted and a smaller opening on the opposite side. The painter reaches through the smaller opening and sprays paint on the surface through the larger opening. The remaining sides are the enclosure's perimeter.

Since overspray tends to follow the surface, the gap between the perimeter and the surface is where overspray escapes into the environment. A seal prevents the overspray from passing through the gap. Typically, fans withdraw air from the interior area of an enclosure. Air from outside of the enclosure flows towards the fan and through the gap. The inflow of air entrains the overspray particles and prevents their uncontrolled release into the environment. This seal can be weakened and overwhelmed for several reasons. The inflow area is the product of the perimeter length and the gap size. A large perimeter, as required for easy painter access, reduces the inflow velocity along the perimeter. Furthermore, the inflow velocity naturally varies around the perimeter. Areas closer to the fan have higher inflow velocities. Areas far from the air suction may experience no inflow.

In addition, an irregular gap increases the gap area and reduces the inflow velocity further. At various points along a large perimeter, the inflow is insufficient to keep the overspray from escaping. Furthermore, when the spray apparatus is not perpendicular to the surface, the apparatus projects paint directly at the gap, overwhelming the seal. Of course, the surfaces being painted are seldom perfectly flat, and, in fact, often tilt away from the enclosure which further affects the gap end the difficulty in sealing. Also, painters always feather the paint application by tilting the spray apparatus away from the surface to give the surface a smooth appearance and this is frequently aimed at the gap area. For these reasons man-sized portable enclosures have not successfully captured the overspray.

In U.S. Pat. No. 5,489,234 an enhanced recovery system was described that used a thin cushion of air to support a nozzle-encasing shroud. The invention's shroud impacts surface irregularities such as welding beads and limits the surface speed. While this approach was practical for paint removal, it is impractical for paint application, since the impacts ruin previously laid paint.

In U.S. Pat. No. 5,688,323 a man-sized, portable spray containment enclosure is disclosed that used a thick plastic shell and a large duct fan to pull the overspray through a filter. While this significantly increased the enclosure-surface gap, it failed to form a consistent seal and in several common situations the seal failed and released the overspray.

U.S. Pat. No. 6,171,656 discloses both a method and apparatus for collecting overspray. The apparatus included a nozzle shroud that was too heavy and bulky to be carried by a man but could be carried by a robot. This structure had a larger gap than other devices and a more consistent seal than some, but restricted the motion of the nozzle rendering the resulting paint surface unacceptable.

BRIEF SUMMARY OF THE INVENTION

The present invention is a portable overspray containment device with an improved seal to capture the overspray from spray painting of large structures such as ships, tanks, and buildings.

DETAILED DESCRIPTION OF THE INVENTION

The spray containment enclosure described herein minimizes the impact of paint spray on adjacent activities, uses proven paint application equipment and procedures, and provides a robust seal. The spray containment enclosure device is self-contained, portable and requires support that is routinely available on an aerial work platform. Further, the apparatus gives the operator direct access to the surface to be painted, allowing the painter to use proven equipment and procedures to produce the desired painted appearance. Finally, the spray containment enclosure apparatus creates a dynamic and flexible seal around the entire periphery thereof with the surface, improving overspray capture.

The improved seal is created by applying an air curtain in the gap between the enclosure and the surface and about the perimeter of the spray containment enclosure. This is accomplished by drawing air from the interior of the enclosure and then blowing the air towards the surface along the enclosure perimeter. The air flow creates an over-pressure zone in the gap between the periphery of the spray containment enclosure and blocks the escape of the overspray out to the atmosphere. The total air flow is proportional with the perimeter and is impervious to the position along the perimeter or to small variations in gap size. The air curtain is also wide enough and strong enough to contain spray from a non-perpendicular application. Thus, the air curtain creates a more robust and effective seal than earlier inventions.

Figure 1:
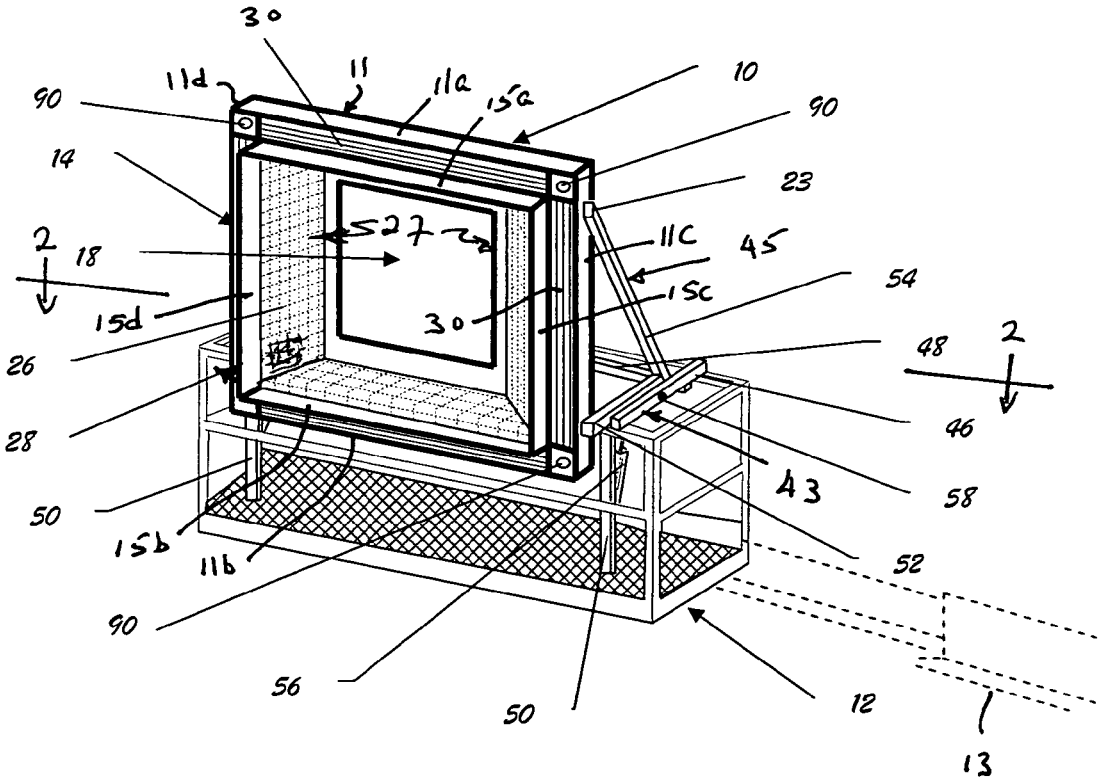
FIG. 1 is a perspective view of an enclosure of the spray painting enclosure mounted on an aerial work platform basket.
Figure 2:
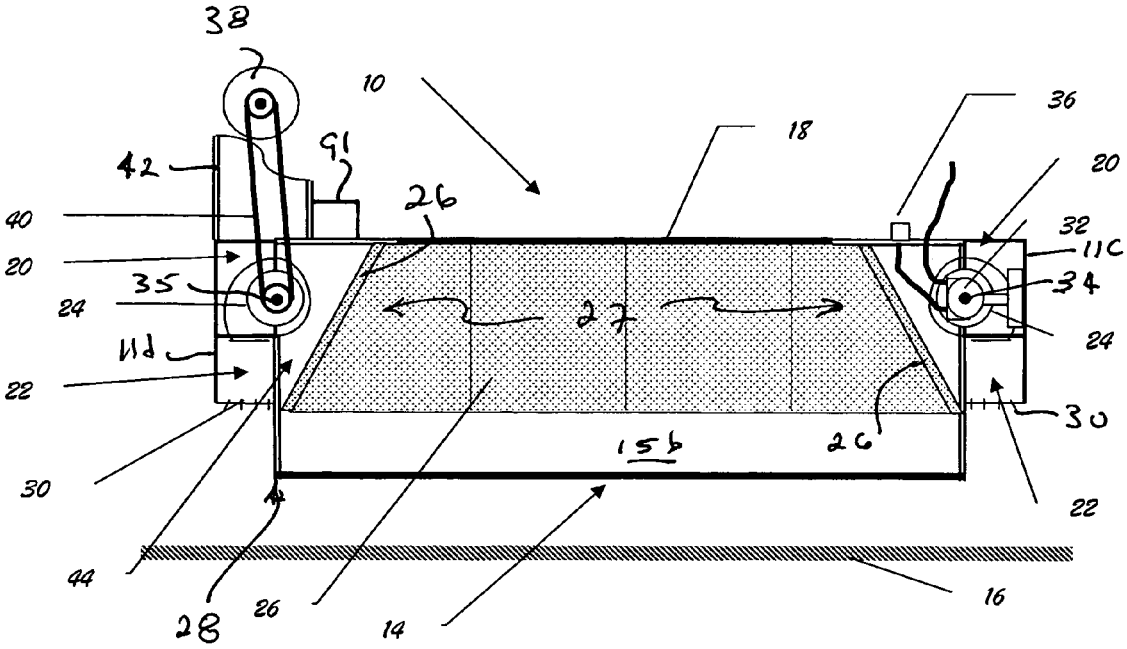
FIG. 2 is a cutaway view along line 2-2 in FIG. 1 of the lower half thereof.

Referring now to the drawings, FIG. 1 shows an enclosure 10, mounted on the basket 12 of an aerial work platform that can be mounted on a variety of devices from power lifts, from a hydraulic lift or other like device, for example as shown in phantom at 13, that will lift and maneuver the basket 12 along and across the surface 16 to be painted. In practical terms the spray containment enclosure will weight about 224 pounds. FIG. 2 shows a cut away drawing of the enclosure 10 at approximately one-half of the height of the enclosure. The enclosure 10 is a relatively short, rectangular tube with a large opening 14 near the surface 16 that is being painted and on the on the opposite end of the tube is a smaller opening 18 at the rear of the spray containment enclosure. The large opening 14 is defined by top wall 15*a*, a bottom wall 15*b* and opposing side walls 15*c* and 15*d* that collectively form the outer portion of the perimeter of the enclosure 10. The area behind the large opening 14 is defined by a fame 11 comprised of a top wall 11*a*, a bottom wall 11*b*, and opposite side walls 11*c* and 11*d*. Vanes 30 form the major portion of the front walls of this frame area. Also, top wall 11*a* is about 100 inches long and about 11 inches deep while wall 15*a* is about 70-90 inches long and about 7 inches deep.

The perimeter 28 of the interior of enclosure 10 contains a series of plenums including, for example, a pair of inner plenums 20, one on each side, and a paid of outer plenum 22, again one on each side. A blower 24, as shown in FIG. 2, is provided on each side and those blowers 24 draw air from the inner plenum 20 and discharge air into the outer plenum 22. Filters 26 separate the inner plenum 20 from the interior area 27 of the periphery 28 of enclosure 10. The outer plenum 22 directs the air through vanes 30 and towards the surface 16 to be painted.

Paints, and particularly maritime paints, include volatile organic compounds which, in proper concentrations, may form an explosive atmosphere. Thus, it is preferred to use explosion proof motors. The motors may be inherently explosion-proof, be fully encased, or may be remotely mounted. An encased electric motor is undesirable because it would add significant weight in the portion of the enclosure that is outside the basket area. FIG. 2 shows two motor options. A preferred embodiment of this enclosure would likely use either one or the other. As shown on the right side of FIG. 2, an air motor 32, which is intrinsically explosion proof and lighter than an encased electric motor, can be mounted in the inner plenum 20 and can drive all of the blowers 24 on one side of the enclosure through a common blower shaft 34 where such motors are in vertical alignment. Since the air motor's exhaust may include lubricating oil, the exhaust port 36 should be towards the rear the enclosure 10.

The left side of FIG. 2 shows a remotely mounted motor 38 mounted behind the enclosure 10. The remote motor 38 drives a common blower shaft 35 through belts 40 with that shaft again driving all vertically aligned motors on that side. The belts 40 are enclosed in a box 42 (shown in cut away) to separate the motor 38 from the inner plenum 20. The remote motor 38 may be stronger than the enclosed motor 32 and is able to drive more blowers. If needed, beveled gears (not shown) can be positioned in or adjacent the corners and used to turn the rotation of a side shaft on the motor into a rotation of horizontal shafts that drive the blowers. In such an arrangement, since the horizontal blowers draw power from gears at both ends, the horizontal shafts do not connect in the center.

FIG. 1 shows the enclosure 10 mounted by a frame 43 on the basket 12 of an aerial work platform. The mounting frame 43 has both static and pivoting members so that the spray containment enclosure is movable relative to the basket 12 and to surface 16 to thereby provide a way to position the spray containment enclosure as needed or desired. The static members are connected to the basket by welding, screws, bolts or other connection approaches, and include bridging members 46 on each side of the enclosure 10, transverse members 48 that extend behind and beneath the enclosure, and vertical members 50. A separate pivot frame 45 is roughly triangular in overall shape and, as shown in FIG. 1, is comprised of a horizontal pivot member 52 with one end attached to side wall 11*c* at a lower point on that side wall as shown, and an angular member 54 with one end also attached to side wall 11*c* but at a point higher than for member 52, and with the opposite ends of both members 52 and 54 being connected together. The pivot frame 45 here does not require a vertical member at the front ends of members 52 and 54 as they are each connected to side wall 11*c*. However, a separate vertical frame member could be employed with that vertical member then being attached itself to side wall 11*c*. A similar set of mounting and pivot frames will be used on the other side of the spray containment enclosure and will be similarly attached. Bridging components 46 bridge the basket and, for example, can be attached to the upper rails of the basket 12.

Transverse members 48 are horizontal and perpendicular to the bridging members 46, add stiffness, and maintain spacing. Vertical members 50 also connect to the basket 12, add stiffness, and provide connection points to the pivoting members. The bridging members 46 contain a robust and strong pivot at a point 58 that is about equal in distance from both sides, and behind the front rail of the basket 12. The pivot point 58 contains a bearing that permits rotation of the pivot frame about a horizontal axis in a way that is parallel to the basket's front rail. The pivot includes a suitable bearing (not shown) that connects to the horizontal member 52 to the pivot frame 45. The length of the angular member 54, or the connection point between the angular member 54 and the vertical member 50, may be adjusted to give the enclosure an initial pitch. A linear actuator 56 on each side of the spray containment enclosure pushes between the vertical static member 50 and the horizontal pivot member 52 to modify the pitch of the enclosure 10.

Figure 3:
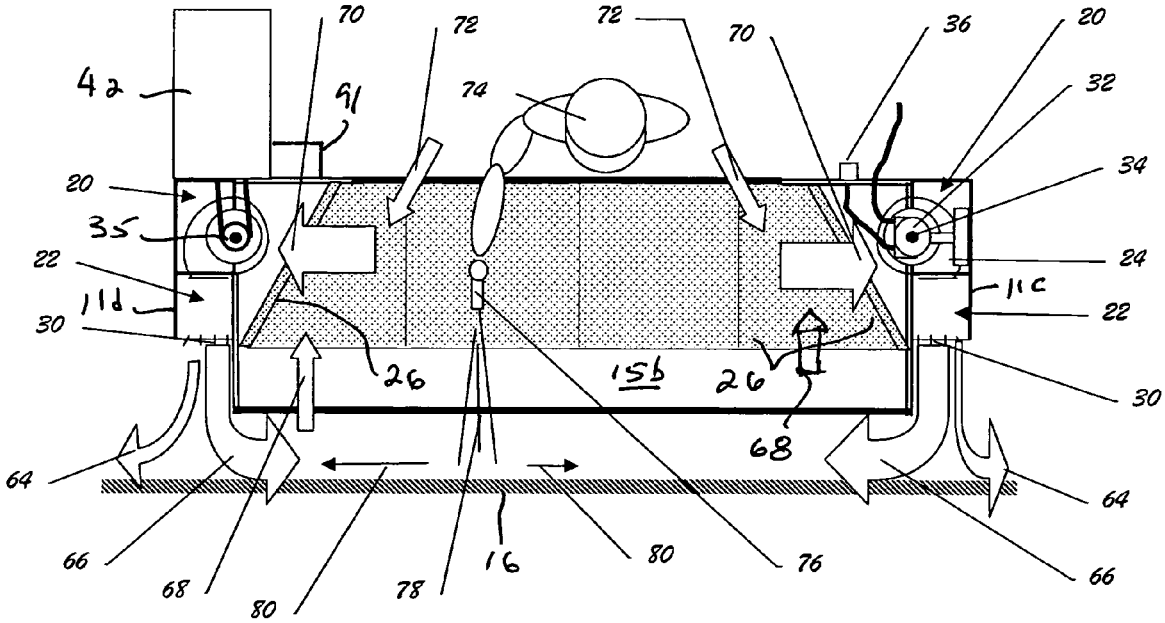
FIG. 3 is a similar cutaway view of the lower half thereof with arrows superimposed to indicate the major air flows when the painter is in the standard position.

In more detail, FIG. 3 is a cut away view of the enclosure 10 at approximately one half of the enclosure's height with arrows superimposed to indicate major air flows. A series of blowers 24 mounted around the perimeter, draw air from an inner plenum 20. The blowers 24 push the air into an outer plenum 22, also located around the perimeter, and towards the surface 16 to be painted. Vanes 30 in the outer plenum 22 direct the air towards the surface 16 such that a portion of the air 64 flows away from and exits the enclosed area and another portion 66 flows towards the interior of the enclosure 10. The painter 74 can apply paint on the surface using conventional spray application equipment 76 to create an application spray 78 of paint that is generally perpendicular to the surface 16. A portion of the paint, the overspray shown at 80, does not adhere to the surface and moves away from the sprayer along the surface 16. The air returning to the enclosed area, shown at 66, entrains the overspray 80 and keeps it within the enclosure 10. The air shown at 68 is then drawn into the interior of the enclosure 10 and that air flow shown at 70 is drawn through the filters 26 thereby depositing the overspray particles of paint in the filter 26. This process repeats in a continuous fashion as painting continues to maintain the air seal and to capture and entrain over spray components so that they can be filtered and kept from escaping to the atmosphere.

Figure 4:
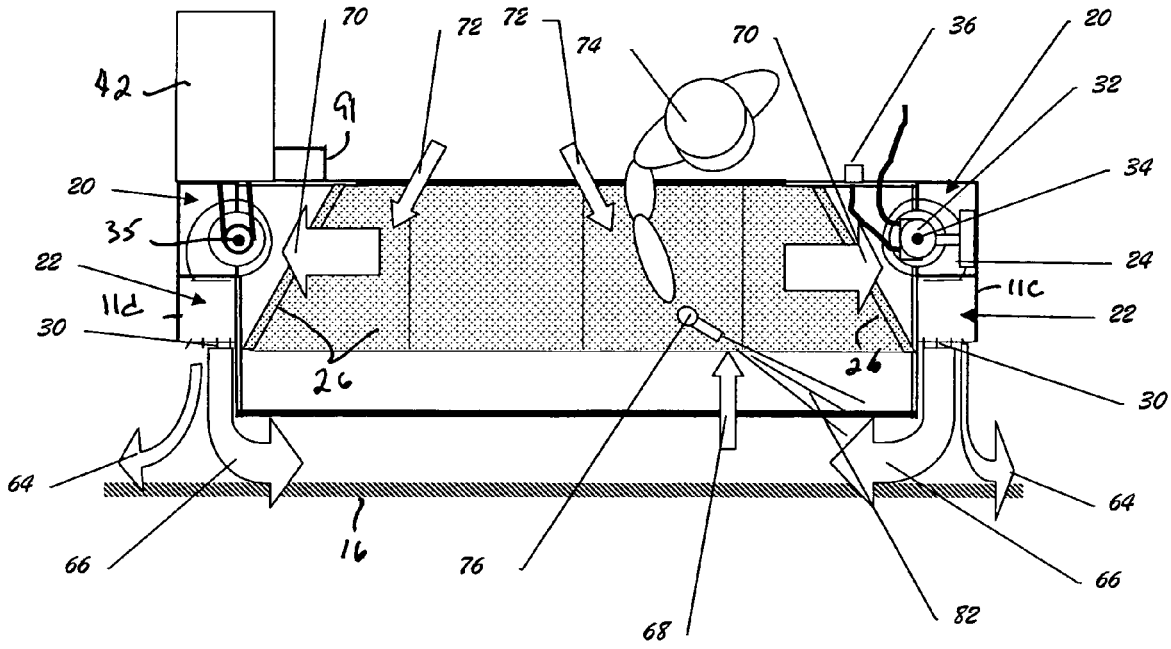
FIG. 4 is a similar cutaway view of the lower half thereof with arrows superimposed to indicate the major air flows when the painter is in an extreme position.

FIG. 4 is also a cut away view of the enclosure 10 and also at approximately one half of the enclosure's height with arrows superimposed to indicate major air flows and the spray apparatus 76 in a feathering position. In a conventional paint application process, the painter 74 will usually move the spray nozzle 76 in back and forth sweeping motions. At the end of each motion, the painter "feathers" the paint by tilting the nozzle 76 away from the surface 16. The tilt causes the resulting spray 82 to flow more directly at the gap that exists between the enclosure 10 and the surface 16. The width of the outer plenum 22, the gap between the vanes 30 and surface 16, and the gap between the periphery of the enclosure 28 and the surface 16, which will preferably vary from about 3 inches to about 6 inches, such that spray directed toward the gap will be picked up by the flow of air shown at 66 will not penetrate to the exhausting air 64.

FIG. 1 shows the positions of sensor systems 90 on the front face of frame 11 that detect the range to the surface 16 from the enclosure 10 at three or more positions and generate a series of signals corresponding to the sensed distance between the surface 16 and the periphery of enclosure 10. As that sensed distance varies the generated signals will reflect such changes. Such generated signals from the sensors 90 are sent to and processed by a control system 91, shown In FIG. 2, that will in turn, control the actuation and resulting movement or position of a portion of the enclosure 10, for example the extended surface panels 102 shown in FIG. 7 or the track mounted inner shroud 320 shown in FIGS. 9 and 10. From this sensed information, a controller for positioning the spray containment enclosure determines the average range, the yaw, and the pitch of the surface relative to the enclosure. The position control system may advise the operator or may automatically adjust the position. The equations for range, yaw, and pitch are:

$$\text{Range} = \frac{1}{n}\sum_{i=1}^{n} Sensor_i$$

$$\text{Yaw} = \arctan\left(\frac{Sensor_1 - Sensor_2}{LateralSeparation_{1,2}}\right)$$

-continued $$\text{Pitch} = \arctan\left(\frac{Sensor_3 - Sensor_2}{VerticalSeparation_{3,2}}\right)$$

Additional applications for the sensors are discussed with alternative embodiments below. Such sensor systems are believed to be well understood, along with a suitable controller, so that further description thereof is not required. Further, the operator could directly and manually make these position adjustments to position the spray containment enclosure as is needed or desired.

Still referring to FIG. 1 to FIG. 4, the enclosure 10 must be large enough to ease painting, light enough to be carried safely by an aerial work platform, and with an appropriate center of gravity. A minimum internal area for the enclosure is four by six feet. The four foot dimension allows the enclosure to seal on curved surfaces. The six foot dimension allows the painter to stroke side-to-side. The enclosure's external dimension will be a bit less than a foot more in each direction. The painter must maneuver the spray nozzle 12-18" from the surface. Thus the enclosure's depth will be 18-24 inches. Most types of aerial work platforms can safely lift 500 pounds. Thus, the total weight of the enclosure system 10 must not exceed 250 pounds. Much of this weight will likely be in the mounting frame and the remote motors such that the center of the entire system 10 is within the aerial work platform's basket 12. If the weight centers outside of the basket, some of the aerial work platforms actuators may not be able to move the basket as intended.

The blowers 24 must be properly sized to the size of the enclosure 10 in order to balance air flow within the spray containment enclosure. When air is withdrawn from a tube near a perpendicular surface, more air returns to the tube than was discharged at the surface. This excess air would flow out of the smaller opening 18. Therefore, the vanes 30 are set such that the magnitude of the returning air flow 66 is less than the filtered air flow 70 passing through filters 26 entering the inner plenum 20. This ensures the air always flows through the smaller opening 18 into the enclosure 10. Thus, the system blows air onto the surface 16 and withdraws air from within the enclosure. As the air moves through the gap between the spray containment enclosure and the surface 16, it entrains more air. Thus, more air may enter the enclosure than is drawn through the filters. If the excess air escapes it may take some overspray out of the enclosure which is not desirable. Thus, a diversion of some amount of air to the outside along the perimeter reduces the total air entering the enclosure such that the flow into the enclosure and the flow through the filers is balanced.

Figure 5:
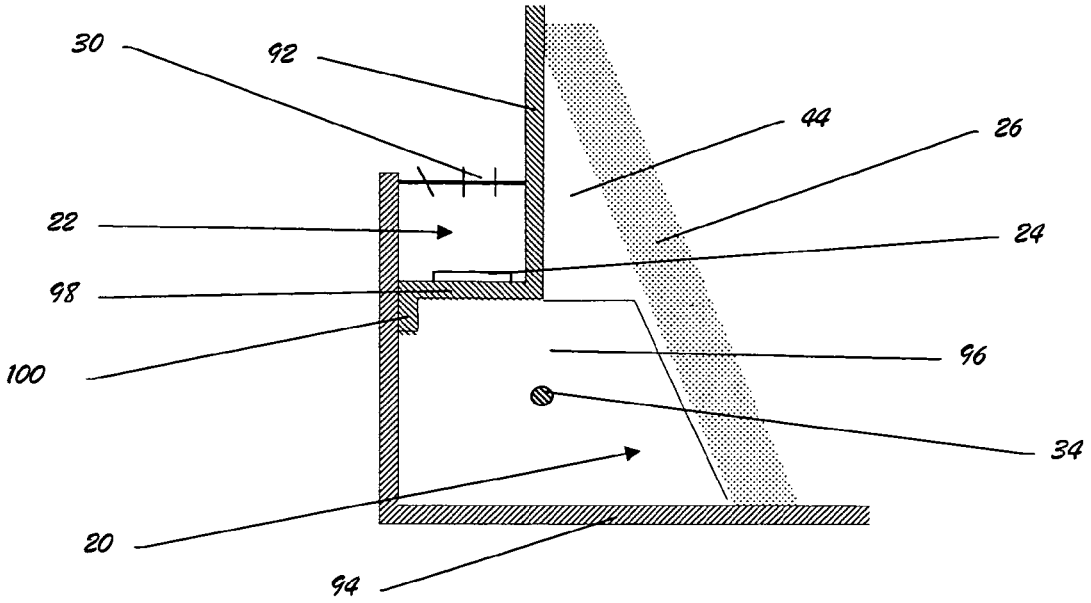
FIG. 5 is a partial cut view of the plenum area with a diagonal filter.
Figure 6:
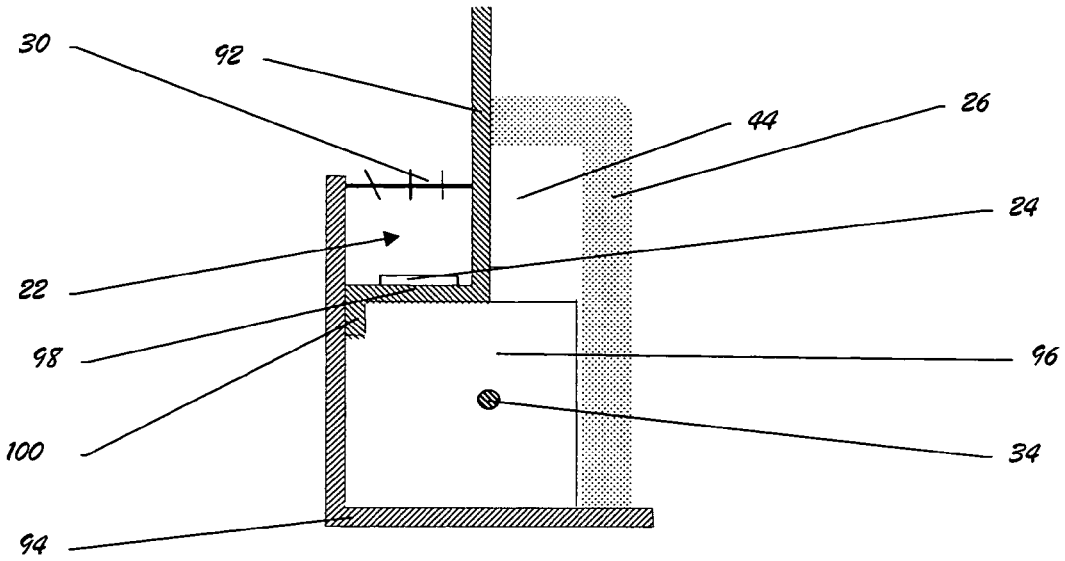
FIG. 6 is a partial cut view of the plenum area with a bent filter.

In more detail FIG. 5 is an enlarged view of the corner from FIG. 2 and FIG. 6 is a similar cut away view of an alternative approach, and each shows further construction details of the spray device. FIG. 5 shows the plenum detail along the vertical side while FIG. 6 shows the plenum detail along the horizontal sides of the device. The enclosure should be constructed of stiff, lightweight material such as aluminum, plastics, and aluminum/plastic composites. The pieces must be strong enough to support their own weight across the width and height of the enclosure, plus the weight of the blowers 24 and motors 32 and 38.

The components of the plenums include various wall members such as are shown at 92 and 94. These may be formed from sheet goods bent in a brake as shown in FIGS. 5 and 6 or they could be made from a stiffer material such as an aluminum coated corrugated plastic, for example Alumalite. The inner surface 92 bends to a short side 98 to support the blower 24 and then to form a tab 100 to connect to the outer surface 94. The outer surface 94 extends from the vanes 30 around the inner plenum 20, to a point past the filter 26. Braces 96 connect the inner surface 98 and outer surface 94 between the blowers 24. The brace 96 improves stiffness but must permit the passage of the blower shaft 34. The structural components can be connected together by adhesives, for example by epoxy adhesives, by bolts, screws, pop rivets or by other fastening techniques.

The filters may be mounted diagonally as in FIG. 5, or may be bent as in FIG. 6. In either situation, a gap 44 must remain between the filter 26 and the inner surface 92. In the preferred embodiment, the filters 26 on the vertical sides are mounted diagonally and the filters 26 on the horizontal sides are bent. This arrangement generates a reliable seal in the corners.

Filters 26 mount on the interior surfaces of the sides. The filter width is a function of the number and type of blowers used. The filter manufacturer specifies the appropriate linear flow rate for optimal filtration (generally 300-500 ft/sec). In the preferred embodiment, the invention uses several self-supporting tackified filter panels. Tackified filters have a sticky substance on the leeward side of the filter and have higher capture efficiency than untackified filters. Self-supporting filter panels have wires within the filters that hold the filter's shape and are lighter than a separate filter-holder configuration. The self-supporting filters' wires may be bent to ensure an appropriate separation 44.

The blowers 24 should be of light weight material such as plastic as is commonly found in the automotive industry. As mentioned previously, the motors 32, 38 can be pneumatic or electric. The selection may be based on the expected availability of power at the work site.

The mounting frame 46, 47, 48, 50, 52, 54 should also be lightweight, but more substantial than the enclosure 10 components. Aluminum tube is an appropriate material for the frame. The pivot actuator 56 may be electric or pneumatic with a slight preference for pneumatic cylinders since their motion is easier to coordinate.

The gap between the inner surface 92 and the surface to be painted 16 should be as small as possible yet large enough to not impact normal extrusions from the surface or the surface 16 at the areas on minimal radius of curvature. For a ship, this value will be approximately 4 inches, and may vary and be a bit less for other surfaces.

Figure 7:
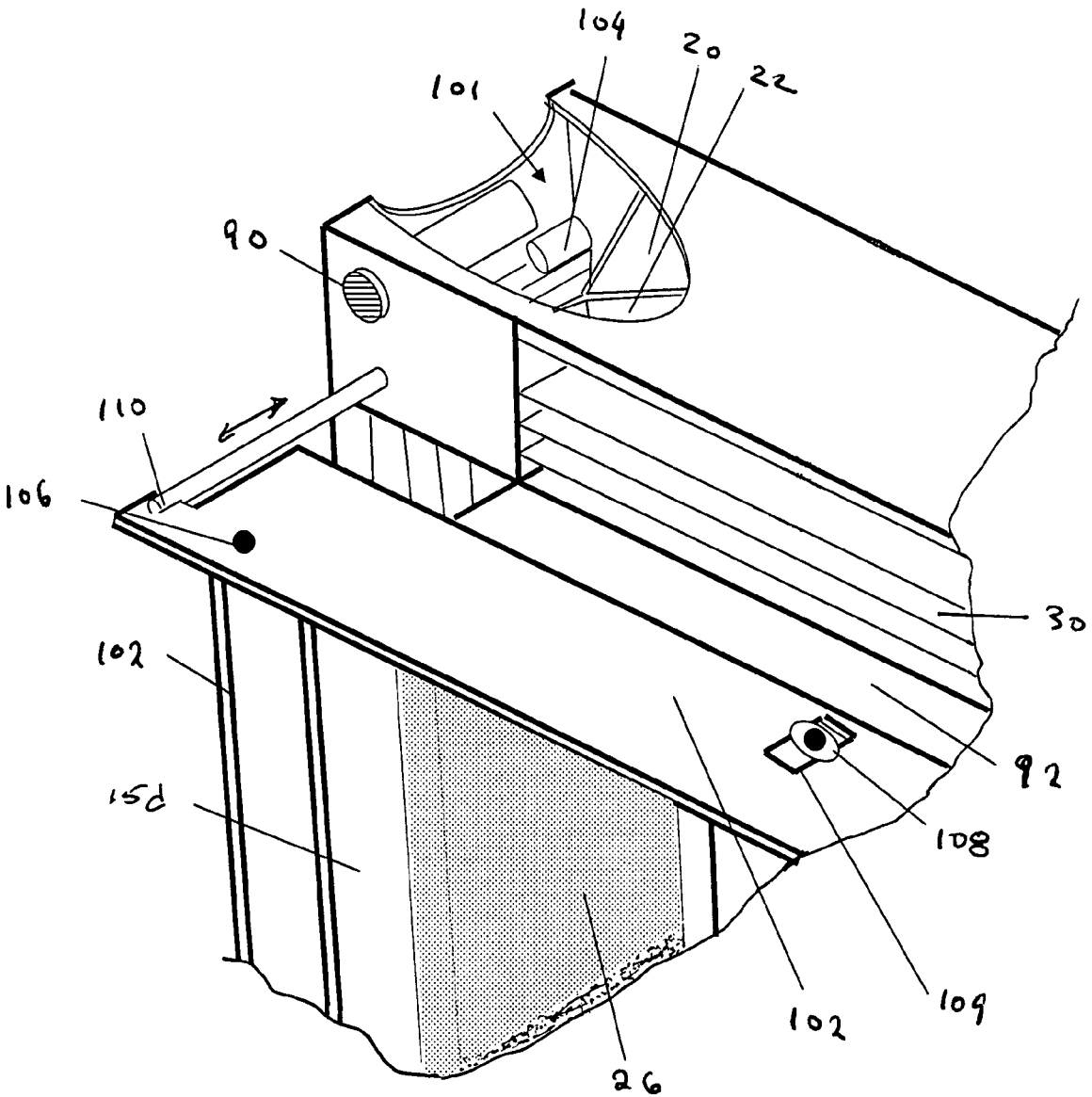
FIG. 7 is a perspective view of a corner of the enclosure with an extending surface.

An alternative embodiment is shown in FIG. 7 which shows one corner of an enclosure equipped with an extended surface that is movable and wherein a cut away view shows portions of inside the corner. The gap between the inner surface of the spray containment enclosure and the surface to be painted 16 contributes to the quality of the seal. The enclosure 10 must be positioned near and parallel to the surface 16 to function properly. An extended surface that is movable compensates for the operator's enclosure positioning errors including where the enclosure 10 is located too far away from the surface 16. FIG. 7 shows features that assist an operator to get the proper sized gap between the enclosure and the surface being painted. An extended panel or surface can be used around the perimeter of the spray containment enclosure and can be adjusted manually or automatically by using the sensors 90. Each extended surface 102 comprise panels located along the exterior of the inner surface 92. The extending surface panels 102 join at the corner with a connection such as a pin 106 or a tab that permits some freedom of motion. Bolts with oversized washers 108 fit through slots 109 in the extending surface panel 102 and permit the panels to rotate slightly while moving laterally.

FIG. 7 also includes a cutaway area in the upper left corner that shows the relative positions of the outer plenum 22, the inner plenum 20, and the corner area 101 which is separated from both plenums. Located within the corner area 101 is a linear actuator 104 that extends outside the corner area 101 through an actuating and linearly movable rod or pin 110 which connects to the extending surface panel 102. The linear actuator may be electric, pneumatic, or the end of a push/pull cable. The range sensors 90, as discussed previously, are also mounted in the corner area. The range sensor 90 measures the distance to the surface 16 and the linear actuator 104, which can be under the control of the control system, can be actuated by the control system to properly position the extending surfaces, like 102, to maintain a desired gap around the whole perimeter of the spray containment enclosure. Sensors 90 in each corner adjust the extending surface 102 adjacent each corner independently, causing the resulting gap to be reasonably uniform throughout the perimeter.

Figure 8:
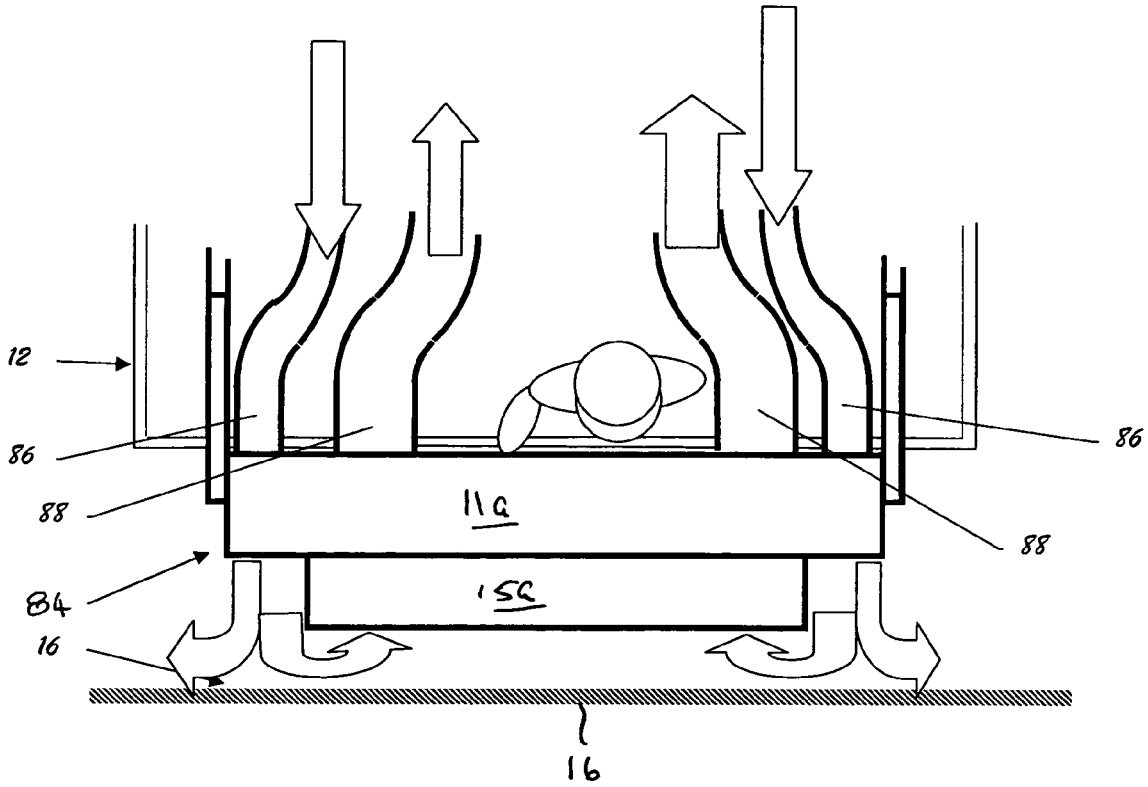
FIG. 8 is an overhead view of an alternative embodiment where the filter and blowers are remote.

Referring now to FIG. 8 this figure shows an alternative embodiment where the blowers and filters are remote from the spray containment enclosure. For the enclosure 84 in FIG. 8, hoses 86 carry compressed air from a remote compressor or fan into the outer plenum of the enclosure 84. Exhaust hoses 88 draw air from the enclosure interior to a remote location for filtering. Other aspects of the invention remain the same. The advantages of this embodiment are the enclosure would be lighter, plus the remote filter can capture more of the overspray particles and could also capture the volatile organic compounds released during painting. The disadvantage of this embodiment is the remote filters and compressors may interfere with other activities and will reduce the portability and flexibility of the invention.

Figure 9:
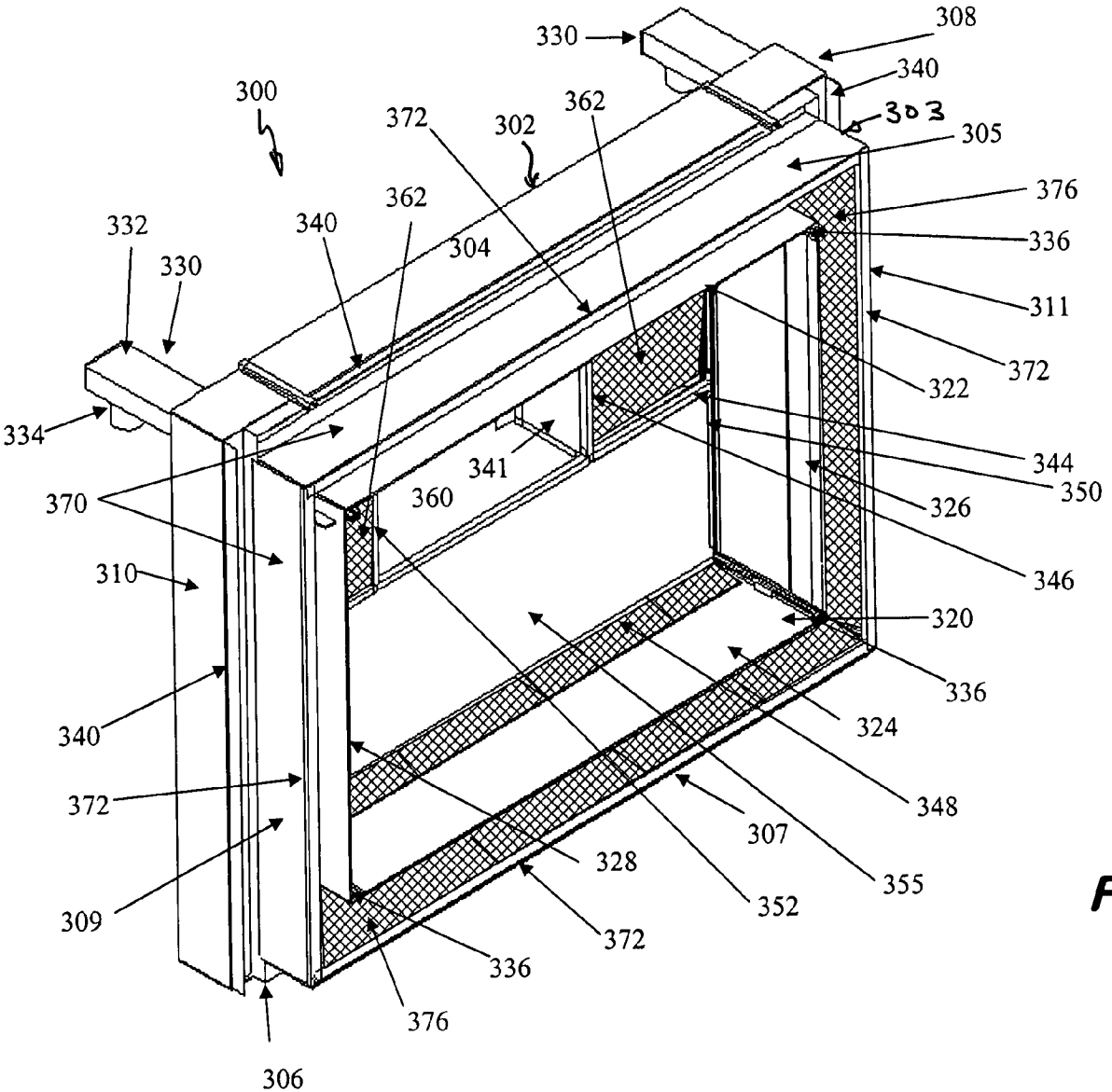
FIG. 9 is a perspective view of another embodiment including an inner shroud.
Figure 10:
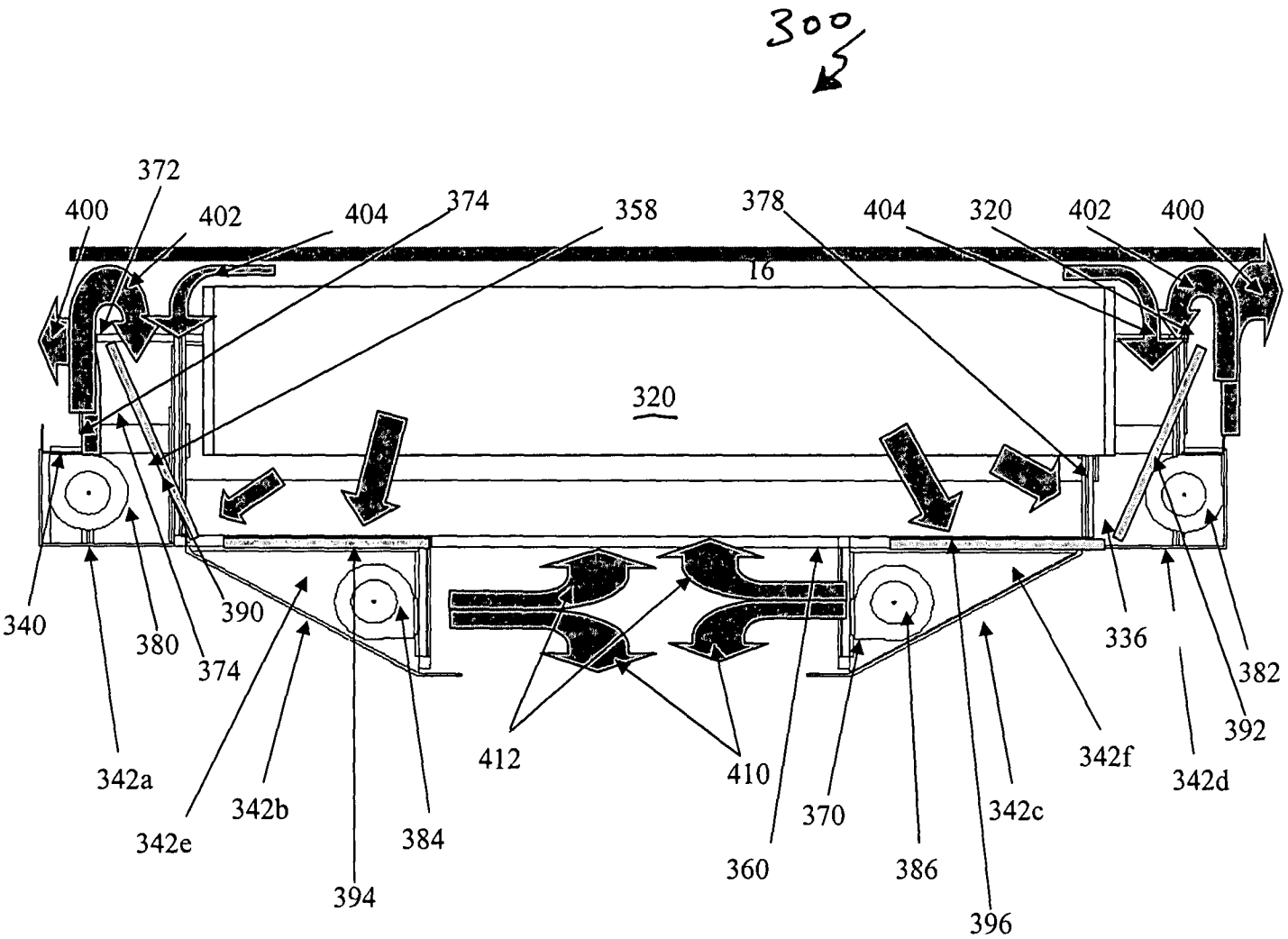
FIG. 10 is a cut away view along line 10-10 of the embodiment shown in FIG. 9 with arrows superimposed indicating the major flows.

FIGS. 9 and 10 show another alternative embodiment of a painting overspray entrainment enclosure that will be mounted to the basket of an aerial work platform or other lifting device, such as that shown in phantom at 13 in FIG. 1, which might be used in the painting of ships, tanks, aircraft, buildings, or other large surfaces. Here the enclosure 300 includes an outer frame 302 comprised of a top 304, a bottom 306, and two opposing sides 308 and 310, an inner frame 303 that is comprised of a top 305, bottom 307, and two opposing sides 309 and 311, an inner shroud 320 comprised of a top 322, a bottom 324 and two side walls 326 and 328, and motor mounts 330. The inner and outer frames, 303 and 302, respectively, are rigidly attached by welding, adhesives, bolts, screws, or similar matter. The inner shroud mounts to rails 336 that are rigidly attached to the outer frame 302 to allow the manual or automatic adjustment of the position of the inner shroud 320.

The outer frame includes blower mounting trays 340, blower mounting plates 341, covers 342*a-f*, an assembly of structural aluminum tubes 344, 346, 348, 350, 352, and panels 355 that fill the areas between the tubes. The outer frame forms a complete shell around the enclosure. Thus, similar covers, panels, plates and tubes are present but not visible in the figures. The blower mounting trays 340 are sheet metal U-shaped channels with appropriate holes to mount a sequence of blowers 380, 382. The trays join at the corners (not shown). The blower mounting plates 341 have mounting holes for a smaller sequence of blowers 384, 386. The covers 342 form the plenums 358 from which the blowers draw air. The assembly of tubes form the painter's access window 360, the window filter mounts 362, and the rear surface of the enclosure. The number of blowers on the trays 340 and plates 341 depends on the overall size of the enclosure. The embodiment shown in FIG. 9 uses 3 dual wheel blowers along each side of the enclosure, 4 dual wheel blowers across the top thereof, 4 dual wheel blowers across the bottom thereof, and 1 dual wheel blower on each side of the window 360.

The inner frame 303, including the top 305, bottom 307 and the sides 309 and 311, include panels 370 and structural U-shaped channels 372. The panels form the plenums from which the blowers draw air 358 and to which the blowers discharge air 374. The U-shaped channels 372 hold the filters 376 in place.

The motor mounts 330 attach to the outer frame and include a belt guard 332 and the motors 334.

The inner shroud 320 mounts to rails 336 that attach to the outer frame 3302. The distance from the wall 16 to the shroud 320 is generally less than the distance from the wall to the inner frame. The shroud is thinner than the inner frame such that a space exists between the shroud and the outer frame.

FIG. 10 shows the major air flows within the enclosure. Blower sets 380, 382, 384, and 386 draw air through filters 390, 392, 394, and 396 respectively. Blower set 380 and 382 discharge air toward the surface 16 such that a portion of the air 400 moves away from the enclosure 300 and a portion 402 flows through the gap between the wall 16 and the inner shroud 320 and back into the enclosure 300. The returning air entrains the paint overspray 404 and returns to the filter 390, 392. Blower sets 384 and 386 discharge air across the painter's access window 360 such that a portion of the air 410 flows away from the enclosure 410 and a portion 412 returns to the enclosure 300.

While the air flows shown in FIG. 10 are directed in particular directions, it should be understood that air flows about the entire periphery of enclosures 10 and 300 as well as throughout the whole interior of the enclosure 300. Thus, air flows like those shown at the sides also exist and flow along the top and bottom edges in similar fashions so that a resulting air seal exists about the entire periphery of each of the embodiments of the enclosures 10 and 300. It should also be understood that the resulting air seal is dynamic and capable of, in a sense, absorbing or accommodating changes in the distance by which the enclosure 10 or 300 is spaced from the surface 16 being painted as the enclosure is positioned by the mechanism being used to position and move the enclosure relative to surface 16 during painting. Consequently, the flows of air will be present around the whole periphery of the enclosures 10 and 300 and will establish a dynamic seal that effectively retains over sprays of paint within the enclosure and prevents its escape into the atmosphere.

It should be understood that the outermost edges of front frame 303 will be located a distance from surface that ranges between about 2 inches to about 4 inches, and that the shroud 112 will be located a distance from surface by a distance ranging from about 4 to about 8 inches.

The advantages of the present invention include, without limitation, a robust and compliant seal, portability, and the utilization of standard equipment. Thus, the protection of the environment may be achieved at significantly less cost. It should also be understood that this spray containment enclosure apparatus could also be used to contain and collect hazardous fumes as may be generated by welding and cutting operations that can be carried out on large surfaces, as well as the collection and containment of particles when de-painting or in other operations where dust, fumes or other atmospheric containments might be generated by the particular process.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A paint spray enclosure for use in painting a surface comprised of an outer frame having a rear operator opening therein smaller than the dimensions of the outer frame, an inner frame attached to the outer frame having an opening therein, a support structure on which the outer and inner frames are mounted, the inner frame being attached so that it defines therein an interior space; a plurality of baffles, and at least one air blowing and intake system to establish a positive air flow toward the surface at the lateral sides of the enclosure forming inwardly and outwardly directed air flow paths along the surface relative to a gap formed between the front most portion of the enclosure and the surface so that an air seal is formed therein, with the inwardly directed portion of that sealing air flow directed inside the interior frame and the outwardly directed portion directed outside the outer frame and, balancing the air seal to produce a net flow-path inwardly through the operator opening in the outer frame, and a plurality of filter assemblies toward and through which the inwardly directed air flow is pulled.

2. The paint spray enclosure as in claim 1 wherein the outer frame is positionable relative to the surface and relative to the support structure.

3. The paint spray enclosure as in claim 1 wherein outer frame position is manually adjustable.

4. The paint spray enclosure as in claim 1 further including a plurality of sensors to monitor the distance between the enclosure and the surface and to generate signals corresponding to variations in that sensed distance, a control system to receive the signals generated by the plurality of sensors and to adjust a portion of the enclosure in response thereto to maintain a desired gap between the surface and the enclosure.

5. The paint spray enclosure as in claim 1 wherein a front surface of the enclosure includes a plurality of openings directing air flow toward the surface.

6. The paint spray enclosure as in claim 1 further including an inner shroud that is movably mounted on the enclosure and covers at least an interior portion of the plurality of filter assemblies.

7. The paint spray enclosure as in claim 6 wherein the inner shroud is manually movable.

8. The paint spray enclosure as in claim 6 wherein the inner shroud is automatically movable to maintain a gap between the enclosure and the surface being painted.

9. The paint spray enclosure as in claim 1 wherein said at least one air blowing and intake system withdraws air from within the enclosure and creates an air flow directed outwardly from portions of the enclosure to form the air seal about the perimeter of the enclosure to thereby fill the gap between that perimeter and the surface with air.

10. The paint spray enclosure as in claim 9 wherein said at least one air blowing and intake system includes a plurality of individual blowers.

11. The paint spray enclosure as in claim 10 wherein each of the plurality of blowers pulls air through at least one filter and discharges air along a path to create the air seal.

12. The paint spray enclosure as in claim 1 wherein the air flow about the periphery of the enclosure includes a plurality of flow paths moving air relative to the periphery, the interior space and the surface, the plurality of air flow paths including a set of flow paths for inwardly directed air flows, a set of flow paths for the outwardly directed portion that is directed away from the interior of the enclosure, and a set of flow paths within the interior of the enclosure, that collectively entrain the constituent parts of over spray of paint being applied to the surface, pull the over spray entrained air into the plurality of filter assemblies and balance the air flow within the enclosure.

13. The paint spray enclosure as in claim 12 wherein the outwardly directed portion directed away from the interior diverts sufficient air to reduce the total air entering the enclosure to balance the inwardly directed flow paths.

14. The paint spray enclosure as in claim 1 wherein the enclosure is mounted on a lift mechanism.

15. The paint spray enclosure as in claim 14 wherein the lift mechanism comprises an aerial work platform.

16. The paint spray enclosure as in claim 1 wherein the air seal within the gap between the surface to be painted and the enclosure is dynamic and capable of accommodating gap distances.

17. A paint spray enclosure for use in painting a surface comprised of:

an outer frame having an operator opening therein, an inner frame assembly attached to the outer frame to define an interior space;

a support structure on which the outer and inner frames of the enclosure are mounted and by which the inner frame can be adjustably positioned relative to the surface to define a gap between a portion of the inner frame and the surface and extending around a perimeter thereof, an air blowing and intake system to draw air from the interior space and establish a positive air flow from around the perimeter and across the gap and toward the surface forming an inwardly directed air flow path along the surface towards the interior space and simultaneously forming an outwardly directed air flow path along the surface and away from the enclosure to form a balancing air flow through the operator opening and into the interior and a plurality of filter assemblies positioned inside the interior space toward and through which at least a portion of the air flow is pulled.

18. The paint spray enclosure of claim 17 wherein the operator opening is smaller in size than the outer frame, and the inner frame assembly includes an opening substantially equal to the size of an inner perimeter of the inner frame.

19. The paint spray enclosure of claim 17 wherein the air blowing and intake system includes at least one blower that pulls air from within the interior space and through the plurality of filter assemblies.

20. The paint spray enclosure of claim 17 wherein the air blowing and intake system further includes a plenum extending around the perimeter of the inner frame through which air is directed toward the surface.

21. The paint spray enclosure of claim 20 wherein structural components forming the perimeter plenum are removably fastened in place.

* * * * *